US005931278A

United States Patent [19]

Watanabe

[11] Patent Number: 5,931,278

[45] Date of Patent: Aug. 3, 1999

[54] RECEIVING DEVICE FOR ROD MEMBERS

[75] Inventor: Tomoichi Watanabe, Tokyo, Japan

[73] Assignee: Japan Tobacco, Inc., Tokyo, Japan

[21] Appl. No.: 08/887,934

[22] Filed: Jul. 3, 1997

[30] Foreign Application Priority Data

Jul. 5, 1996 [JP] Japan ..... 8-176825

[51] Int. Cl.[6] ..... B65G 47/26

[52] U.S. Cl. ..... 198/438; 198/471.1

[58] Field of Search ..... 198/428, 438, 198/471.1, 689.1

[56] References Cited

U.S. PATENT DOCUMENTS

| | | | |
|---|---|---|---|
| 3,602,357 | 8/1971 | Schubert | 198/438 |
| 3,664,891 | 5/1972 | Schubert et al. . | |
| 3,685,633 | 8/1972 | Rudszinat et al. | 198/438 |
| 3,825,105 | 7/1974 | Cristiani | 198/471.1 |
| 5,536,118 | 7/1996 | Schmidt et al. | 198/471.1 X |
| 5,607,043 | 3/1997 | Irikura | 198/471.1 X |
| 5,657,850 | 8/1997 | Suzuki et al. | 198/438 |

FOREIGN PATENT DOCUMENTS

| | | |
|---|---|---|
| 0693257A1 | 1/1996 | European Pat. Off. . |
| 2443764 | 4/1976 | Germany . |
| 1032413 | 6/1966 | United Kingdom . |
| 1409814 | 10/1975 | United Kingdom . |

*Primary Examiner*—James R. Bidwell
*Attorney, Agent, or Firm*—Birch, Stewart, Kolasch & Birch, LLP

[57] ABSTRACT

A receiving device for a double cigarette is provided with a rotatable catcher drum, receiving grooves, suction holes and pusher rods. The receiving grooves are formed on an outer peripheral surface of the catcher drum. Each of the receiving grooves receives the double cigarette from an inlet thereof and guides an advance of the double cigarette. The suction holes are formed on a bottom of each receiving groove and provide braking force to the received double cigarette and temporarily stop the advance of the double cigarette. The pusher rod is arranged in each receiving groove and pushes back the temporarily stopped double cigarette toward the inlet side of the receiving groove and positions the double cigarette in a normal position.

10 Claims, 8 Drawing Sheets

RECEIVING DEVICE FOR ROD MEMBERS

BACKGROUND OF THE INVENTION

1. Field of the Invention

The present invention relates to a receiving device for receiving rod members one by one and changing the transportation direction of the rod member to be received into another transportation path, and particularly relates to a receiving device suitable for reception of double cigarettes from a cigarette manufacturing machine as a catcher device thereof.

2. Description of the Related Art

A filter cigarette manufacturing machine, a so-called filter attachment has a catcher drum. The catcher drum can receive double cigarettes one by one from a cigarette manufacturing machine. More particularly, the cigarette manufacturing device has a conveying path extending toward the filter attachment. The conveying path guides the individual double cigarette delivered from a cutting section of the cigarette manufacturing machine in the axial direction of the double cigarette.

The catcher drum has many receiving grooves on an outer peripheral surface thereof. These receiving grooves are arranged at equal intervals in a circumferential direction of the catcher drum. Each of the receiving grooves is sequentially aligned with the conveying path of the cigarette manufacturing machine as the catcher drum rotates, each of the receiving grooves can receive one double cigarette from the conveying path through an opening at one end of the receiving groove. Thereafter, the double cigarette in the receiving groove is transported in a direction perpendicular to the axial direction of the double cigarette as the catcher drum rotates. Namely, the double cigarette is transferred from the conveying path of the cigarette manufacturing machine onto the catcher drum so that the conveying posture of the double cigarette is switched.

The double cigarette transferred onto the catch drum advances in the receiving groove. During the advance, the double cigarette receives braking force by suction in the receiving groove and is temporarily stopped. Thereafter, the double cigarette is moved by positioning means and is positioned in a regular position in the receiving groove. For example, the positioning means may includes a stopper arranged on the other end side of the receiving groove or the regular position and pulling means for pulling the double cigarette in the temporary stopping state by suction until the double cigarette comes in contact with the stopper.

The braking force and pulling force for the double cigarette are respectively provided by suction, respectively, when the double cigarette is temporarily stopped in the receiving groove and the double cigarette is moved from the temporary stopping position to the stopper. It is difficult to constantly maintain the braking force and the pulling force at any time.

Therefore, the temporary stopping position of the double cigarette is also changed in the receiving groove by a change in the braking force. For example, when the temporary stopping position of the double cigarette is separated far from the stopper, no pulling force of the pulling means can be moved until the double cigarette comes in contact with the stopper. Accordingly, no double cigarette can be accurately positioned in the receiving groove.

On the other hand, when the temporary stopping position of the double cigarette is normal and the pulling force provided by the pulling means is excessively strong, the double cigarette strongly runs into the stopper so that a cut end of the double cigarette is damaged and shredded tobacco drops from the cut end thereof.

The above-mentioned problems are also caused by a change in size of the double cigarette as well as changes in the braking force and the pulling force. Namely, when the double cigarette is changed in weight, the braking force and the pulling force for the double cigarette must be adjusted in accordance with the weight of the double cigarette. However, much labor and time are required to make this adjustment.

SUMMARY OF THE INVENTION

An object of the present invention is to provide a receiving device for rod members, which can accurately position the received rod member even when suction force is changed, and can sufficiently cope with rod members having different lengths or weights.

The above-mentioned object is achieved by a receiving device according to the present invention, the receiving device comprising a receiving drum rotatably arranged on a terminal end side of a conveying path for a rod member, the receiving drum including an outer peripheral surface moved in a direction crossing the conveying path and receiving grooves formed on the outer peripheral surface of the receiving drum at equal intervals in a circumferential direction. Each of the receiving grooves sequentially pass through a receiving position opposed to a terminal end of the conveying path as the receiving drum rotates, whereby each of the receiving grooves receives the rod member delivered from the conveying path through an inlet thereof and allows the received rod member to advance in an axial direction of the receiving drum.

The receiving device further comprises braking means for applying braking force to the rod member in the receiving groove and stopping the advance of the rod member, and positioning means for pushing back the rod member stopped in the receiving groove toward the inlet of the receiving groove and positioning the rod member in a normal position defined in the receiving groove. The positioning means includes a pusher movably arranged in each receiving groove, the pusher having a rest position separated by a predetermined distance from the rod member stopped by the braking means.

According to the above-mentioned receiving device, a receiving groove of the drum receives the rod member from the conveying path when the receiving groove reaches the receiving position, i.e., when the inlet of the receiving groove and the conveying path are opposed to each other. The received rod member advances in the receiving groove. In a process of this advance, the rod member receives the braking force and is temporarily stopped in a position overrunning from the normal position. Thereafter, the rod member in the temporary stopping state is pushed back toward the inlet side of the receiving groove by the pusher and is positioned in the normal position. Thus, the rod member is accurately positioned in the normal position even when there is a little dispersion in the temporary stopping position of the rod member in the receiving groove.

The braking means can include a cover for covering the outer peripheral surface of the receiving drum and extending from the receiving position in the circumferential direction of the receiving drum with respect to a rotating direction of the receiving drum. When the receiving groove passes through the interior of the cover as the receiving drum rotates, this receiving groove forms a tunnel in cooperation with the cover. In this case, the braking means further includes sucking holes formed on a bottom surface of each receiving groove, and first suction means for applying first suction to the suction holes in a predetermined angular region of the receiving drum after the receiving groove moves into the cover. In accordance with such braking means, the rod member advancing in the receiving groove is braked by the suction from the suction holes and is temporarily stopped.

The braking means can further include discharging means for discharging air in the receiving groove and pulling the rod member in the receiving groove toward a temporary stopping position, and the discharging means has a discharging port formed in the cover. When the rod member is received in the receiving groove, the air discharged from the discharging port pulls the rod member toward the pusher and assists the advance of the rod member. In this case, the rod member reliably overruns the normal position in the receiving groove and can be stopped even when a delivering speed of the rod member from the conveying path is lower than a normal speed.

The discharging port can be arranged in the receiving position with respect to the a circumferential direction of the cover. In this case, when the receiving groove passes through the receiving position, the air in the receiving groove is discharged through the discharging port.

The discharging means preferably further has adjusting means for adjusting discharging force for the receiving groove.

The positioning means can further include reciprocating means for reciprocating the pusher in the receiving groove at a predetermined stroke. Concretely, the reciprocating means can be realized by cam means utilizing rotation of the receiving drum.

In this case, the cam means allows the pusher to come in contact with the rod member before a moving speed of the pusher becomes a maximum speed thereof when the pusher is moved from its rest position toward the rod member. Therefore, the pusher slowly comes in contact with the rod member so that no cut end of the rod member is damaged.

The positioning means can further include second suction means for applying second suction to the sucking holes of the receiving groove and holding the rod member in the receiving groove, and the second suction is weaker than the braking force provided by the first suction.

In this case, the pusher pushes back the rod member against the holding force provided by the second suction.

The receiving device can further include cleaning means for cleaning the interior of the receiving groove by compressed air before each receiving groove reaches the receiving position. Since the receiving groove passing through the receiving position is in an already cleaned state, the rod member in the receiving groove is smoothly advanced and pushed back without having any bad influence by dust in the receiving groove.

Further scope of applicability of the present invention will become apparent from the detailed description given hereinafter. However, it should be understood that the detailed description and specific example, while indicating preferred embodiment of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompany drawings which are given by way of illustration only, and thus, are not limitative of the present invention, and wherein.

DETAILED DESCRIPTION OF THE PREFERRED EMBODIMENTS

Figure 1:
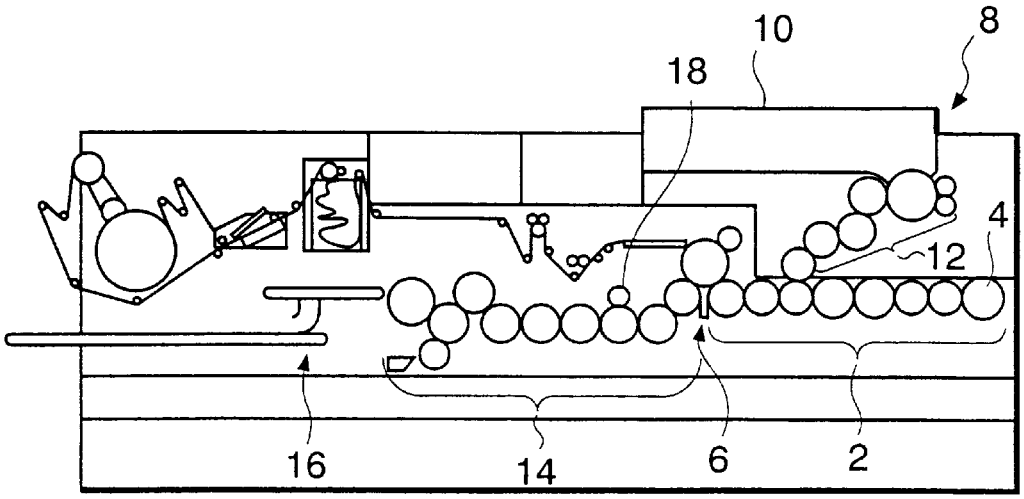
FIG. 1 is a schematic constructional view of a filter attachment.

Referring to FIG. 1, a filter attachment has a drum train 2 extending in a horizontal direction. The drum train 2 includes plural grooved drums adjacent to each other. A grooved drum located at a right-hand end of the drum train 2 in FIG. 1 is used as a catcher drum 4. A conveying path (not shown) of a cigarette manufacturing machine (not shown) extends to a portion near the catcher drum 4. The catcher drum 4 can receive double cigarettes one by one from the conveying path of the cigarette manufacturing machine. Each of the double cigarette has a length twice the length of a cigarette portion in a filter cigarette.

Figure 2:
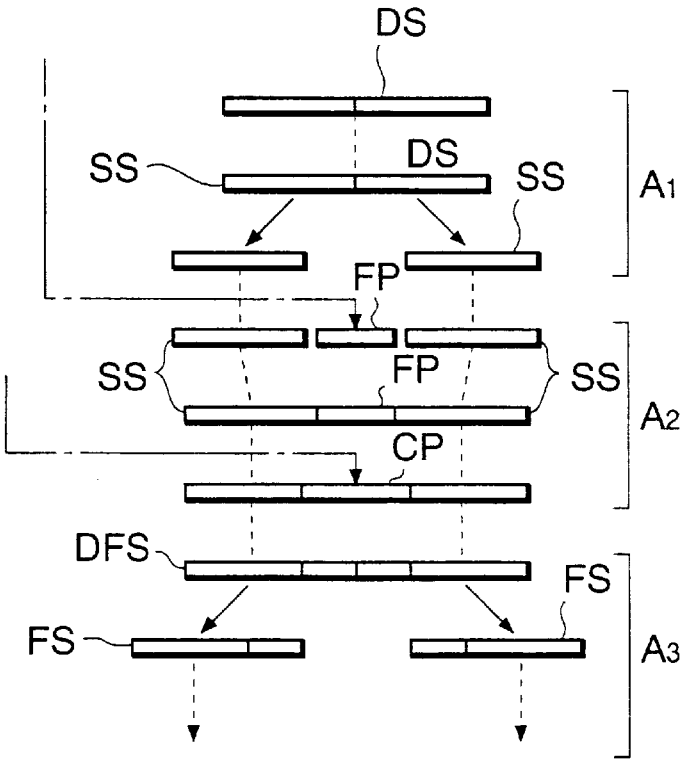
FIG. 2 is a flow chart showing a manufacturing procedure of filter cigarettes in the filter attachment.

As is well known, the double cigarette received by the catcher drum 4 is sequentially transferred to an adjacent grooved drum and is supplied from the catcher drum toward a rolling section 6. The drum train 2 includes a grooved drum having a rotary knife, i.e., a knife drum. When the double cigarette passes through the knife drum, the double cigarette is cut into two equal lengths so that left-hand and right-hand single cigarettes are obtained. Further, two grooved drums located on a downstream side from the knife drum in the drum train 2 are constructed as separation drums. When the left-hand and right-hand single cigarettes pass through the separation drums, the left-hand and right-hand single cigarettes are separated from each other in an axial direction thereof. As a result, after the left-hand and right-hand cigarettes pass through the separation drums, a predetermined space is secured between them. A process from the above-mentioned cutting of the double cigarette to the separation of the left-hand and right-hand single cigarettes is shown in a region $A_1$ in FIG. 2. In FIG. 2, reference symbols DS and SS designate a double cigarette and a single cigarette, respectively.

Further, a filter supplying device 8 is arranged above the drum train 2 and has a hopper 10 for filter rods. A drum train 12 connects the hopper 10 and the drum train 2 to each other. The filter rods taken out of the hopper 10 one by one are sequentially transferred to an adjacent grooved drum in the drum train 12 and is transported toward the drum train 2. The filter rod is cut into filter plugs having a predetermined length during the transportation thereof. The individual filter plug is supplied to a grooved drum downstream from the separation drums in the drum train 2, i.e., a collecting drum.

As a result, the left-hand and right-hand single cigarettes and one filter plug are arranged on the same line on the collecting drum in a state in which the filter plug is arranged between the two single cigarettes.

In a subsequent transportation process, the left-hand and right-hand single cigarettes come in close contact with both ends of the filter plug and become one rod unit. Thereafter, the rod units are supplied to the rolling section 6.

The rod unit and a tip paper piece are simultaneously supplied to the rolling section 6. One face of the tip paper piece is coated with paste. When the rod unit is rolled on the rolling section 6, the tip paper piece is wound around the rod unit. More particularly, the filter plug of the rod unit is connected to the left-hand and right-hand single cigarettes by the winding of the tip paper piece. Thus, a double filter cigarette constructed by two filter cigarettes is formed. The processes described so far are shown in a region $A_2$ in FIG. 2. In FIG. 2, reference symbols FP, CP and DFS designate a filter plug, a tip paper piece and a double filter cigarette, respectively. The tip paper piece is obtained by cutting tip paper a predetermined length and the tip paper is drawn out of a roll.

A drum train 14 is arranged on a side opposed to the drum train 2 and also extends from the rolling section 6 in the horizontal direction. The double filter cigarette formed in the rolling section 6 is transported on the drum train 14. In a process of this transportation, the double filter cigarette is equally cut from its center by the rotary knife. Thus, individual filter cigarettes are obtained and are separated from each other leftward and rightward. This process is shown in a region $A_3$ in FIG. 2. In FIG. 2, reference symbol FS designates filter cigarettes. Thereafter, the filter cigarettes are transported toward a packing machine (not shown) through a conveyer 16.

Figure 3:
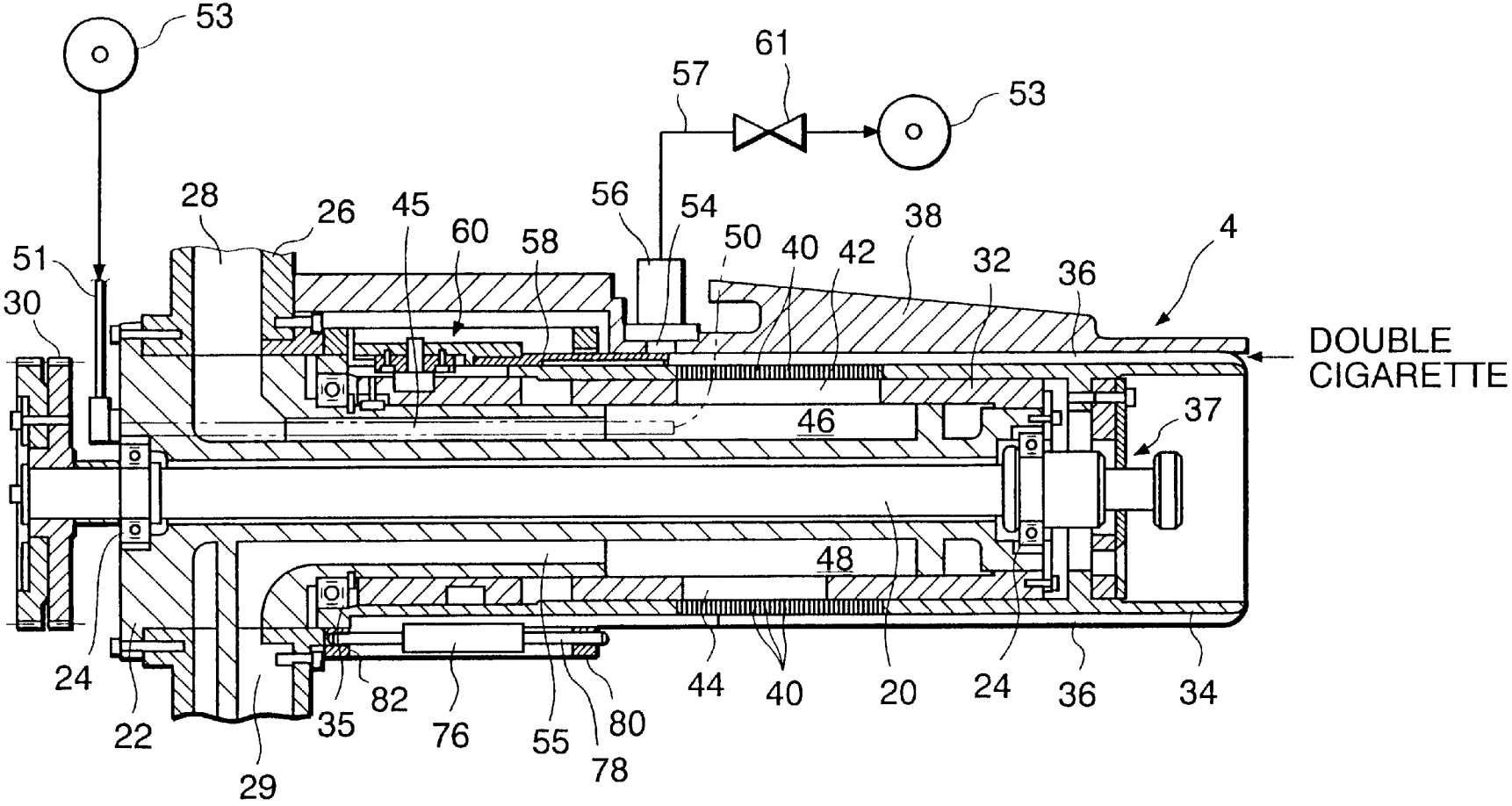
FIG. 3 is a longitudinal sectional view of a catcher drum.

Referring to FIG. 3, a receiving device including the catcher drum 4 is shown in detail. The catcher drum 4 has a horizontal drum shaft 20. The drum shaft 20 extends through a fixing sleeve 22 and is rotatably supported through a pair of bearings 24 with respect to the fixing sleeve 22. A predetermined clearance is secured between the fixing sleeve 22 and the drum shaft 20. The fixing sleeve 22 horizontally extends from a main frame 26 of the filter attachment and has one end portion airtightly fitted into the main frame 26. Namely, the fixing sleeve 22 is supported by the main frame 26 in its one end portion.

Negative pressure passages 28, 29 are defined in the main frame 26 and are separated from each other. Each of the negative pressure passages 28, 29 is connected to a corresponding negative pressure source (not shown) at any time. Here, a negative pressure supplied to the negative pressure passage 28 is stronger than that supplied to the negative pressure passage 29.

The drum shaft 20 is projected from each of both ends of the fixing sleeve 22. A gear 30 is attached to one end of the drum shaft 20 on the side of the main frame 26. Rotating force can be inputted from an power transmitting system (not shown) to the gear 30. Accordingly, when the rotating force is inputted to the gear 30, the drum shaft 20 is rotated in a predetermined direction through the gear 30.

A control sleeve 32 is fixed on the fixing sleeve 22 and extends from a portion near the main frame 26 to the other end of the fixing sleeve 22. Further, a drum shell 34 is rotatably attached onto the control sleeve 32 and covers the fixing sleeve 32. One end of the drum shell 34 is rotatably supported on the fixing sleeve 22 through a bearing 35. Another end portion of the drum shell 34 greatly exceeds the control sleeve 32 and projects.

The other end of the drum shaft 20 and the drum shell 34 are detachably coupled to each other through a coupling mechanism 37. Accordingly, the drum shell 34 can be rotated together with the drum shaft 20. An explanation with respect to the coupling mechanism 37 is omitted.

Many receiving grooves 36 are formed on an outer peripheral surface of the drum shell 34 and are arranged in the half of the drum shell 34 separated far from the main frame 26. The receiving grooves 36 are arranged at equal intervals in a circumferential direction of the drum shell 34 and have inlets opened at the other end of the drum shell 34.

When each of the receiving grooves 36 reaches a predetermined rotating angle position, i.e., a receiving position as the drum shell 34 rotates, the receiving groove 36 is located on the same line as the above-mentioned conveying path of the cigarette manufacturing machine. Here, the double cigarette manufactured by the cigarette manufacturing machine is intermittently delivered on its conveying path.

Figure 4:
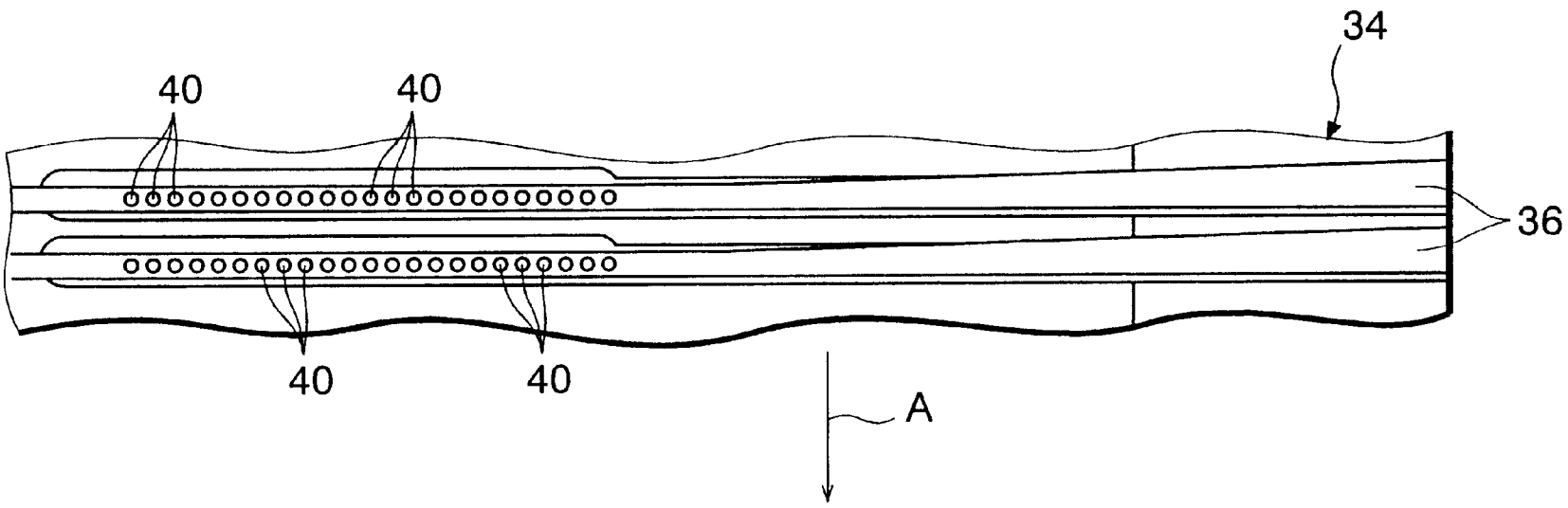
FIG. 4 is an enlarged plan view showing receiving grooves of the catcher drum.

The receiving grooves 36 are shown on an enlarged scale in FIG. 4. Both side walls of each receiving groove 36 are not parallel to each other in an inlet portion thereof. A side wall of the receiving groove 36 located backward with respect to a rotating direction of the drum shell 34 is inclined to enlarge the width of the inlet of the receiving groove 36. An arrow A in FIG. 4 shows the rotating direction of the drum shell 34.

A shell cover 38 is arranged outside the drum shell 34. As can be seen from FIG. 3, the shell cover 38 covers all regions of the drum shell 34 seen from the axial direction of the drum shell 34. However, as can be seen from FIG. 5, the shell cover 38 covers only one portion of the outer peripheral surface of the drum shell 34 with respect to the circumferential direction thereof. More specifically, the shell cover 38 extends from a position just before the above-mentioned receiving position of the receiving groove 36 seen from the circumferential direction of the drum shell 34 to a predetermined rotating angle position in the rotating direction of the drum shell 34.

When each receiving groove 36 enters the shell covers 38 as the drum shell 34 rotates, the receiving groove 36 forms a tunnel passage in cooperation with the shell cover 38.

As shown in FIGS. 3 and 4, each receiving groove 36 has many suction holes 40 on the bottom surface thereof. These suction holes 40 define a suction region extending in the axial direction of the receiving groove 36. More specifically, the suction holes 40 are arranged at equal intervals in the axial direction of the receiving groove 36. It is secured that the suction region is longer than the entire length of the double cigarette. Each of the suction holes 40 extends in a radial direction in the drum shell 34 and is opened on an inner peripheral surface of the drum shell 34.

A first suction slot 42 and a second suction slot 44 are respectively formed in the control sleeve 32 in axial positions corresponding to the suction region of the receiving grooves 36. The first suction slot 42 extends from the above-mentioned receiving position of the drum shell 34 to a first angular region $\alpha 1$ (for example, 60°) with respect to the rotating direction of the drum shell 34. As can be seen from FIG. 5, the first angular region $\alpha 1$ is included within a region covered by the shell cover 38. When the receiving groove 36 enters the first angular region $\alpha 1$ as the drum shell rotates, the suction holes 40 of the receiving groove 36 is connected to the first suction slot 42 of the control sleeve 32.

Figure 5:
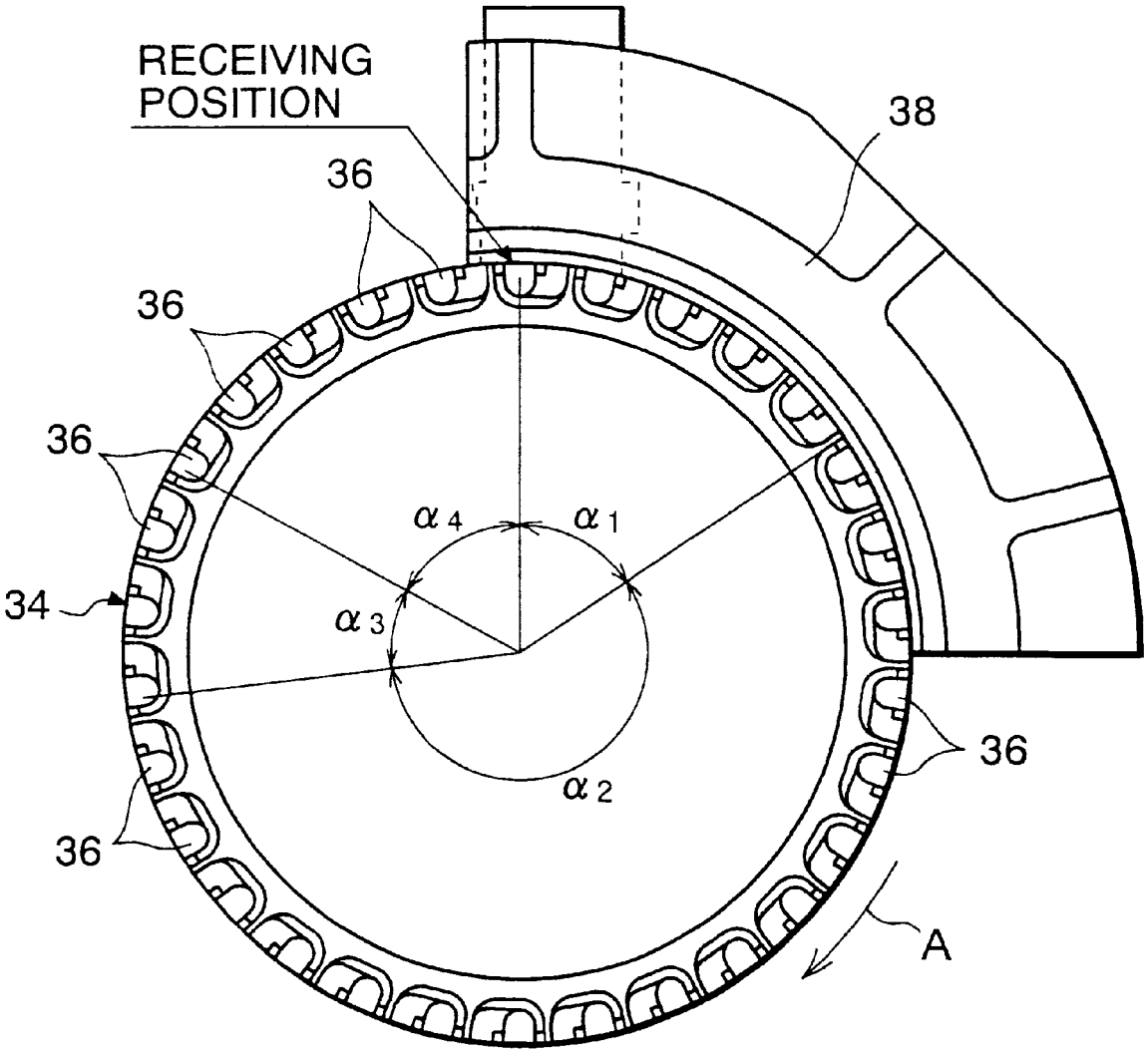
FIG. 5 is a schematic front view of the catcher drum.

As shown in FIG. 5, the second suction slot 44 extends from a portion near the first suction slot 42 to a second angular region $\alpha 2$ (for example 240°) in the the rotating direction of the drum shell 34. Here, as can be seen from FIG. 3, a width of the second suction slot 44 with respect to the axial direction of the control sleeve 32 is narrower than that of the first suction slot 42. One side edges of the first and second suction slots 42, 44, which are separated far from the inlet of the receiving groove 36, are located on the same circumference of a circle.

An atmospheric groove 43 is further formed on the outer peripheral surface of the control sleeve 32. The atmospheric groove 43 is located behind the second suction slot 44 over a third angular region α3 (see FIG. 5) with respect to the rotating direction of the drum shell 34. As can be seen from FIG. 6, a slight clearance is secured between the atmospheric groove 43 and the second suction slot 44. The atmospheric groove 43 extends in the axial direction of the control sleeve 32 and one end of the atmospheric groove 43 is communicated with the atmosphere.

Suction grooves 46, 48 are respectively formed on the outer peripheral surface of the fixing sleeve 22. As can be seen from FIG. 6, the suction grooves 46, 48 are connected to the first and second suction slots 42, 44 of the control sleeve 32, respectively. The suction groove 46 is communicated with the negative pressure passage 28 in the main frame 26 through an internal passage 45 formed in the fixing sleeve 22. The suction groove 48 is communicated with the negative pressure passage 29 in the main frame 26 through an internal passage 55 formed in the fixing sleeve 22. Therefore, the suction grooves 46, 48 can respectively receive negative pressures from the negative pressure passages 28, 29. The negative pressures in the sucking grooves 46, 48 are therefore supplied to the first and second suction slots 42, 44, respectively. Here, as mentioned above, a negative pressure difference is kept between the pressures in the negative pressure passages 28 and 29. Therefore, the negative pressure supplied into the second suction slot 44 is weaker than that supplied into the first suction slot 42.

Figure 6:
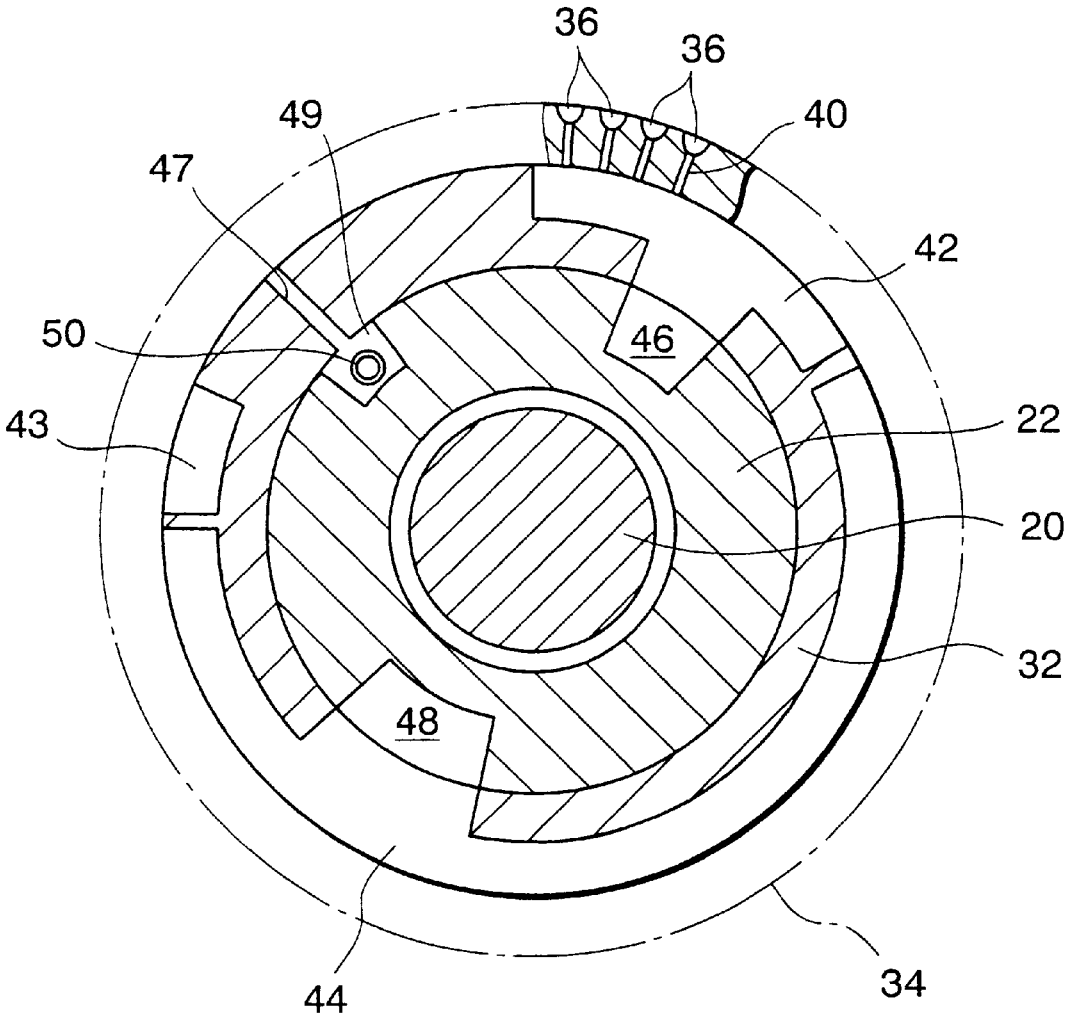
FIG. 6 is a schematic transversal sectional view of the catcher drum.

Further, an inner blow tube 50 extends into the fixing sleeve 22 and is shown by a two-dotted chain line in FIG. 3. As shown in FIG. 3, one end of the inner blow tube 50 is projected outside from one end face of the fixing sleeve 22 and is connected to an outer blow tube 51 through a connector. The outer blow tube 51 is connected to a pneumatic source 53. As shown in FIG. 6, the other end of the inner blow tube 50 is opened into a blow groove 49. The blow groove 49 is formed on the outer peripheral surface of the fixing sleeve 22. A blow slot 47 is further formed in the control sleeve 32. The blow slot 47 extends from the blow groove 49 and is opened on the outer peripheral surface of the control sleeve 32. The blow slot 47 is located between the atmospheric groove 43 and the first suction slot 42 with respect to the rotating direction of the drum shell 34. Namely, the blow slot 47 is located within a fourth angular region α4 (see FIG. 5) between the third angular region α3 and the first angular region α1 mentioned above.

Figure 7:
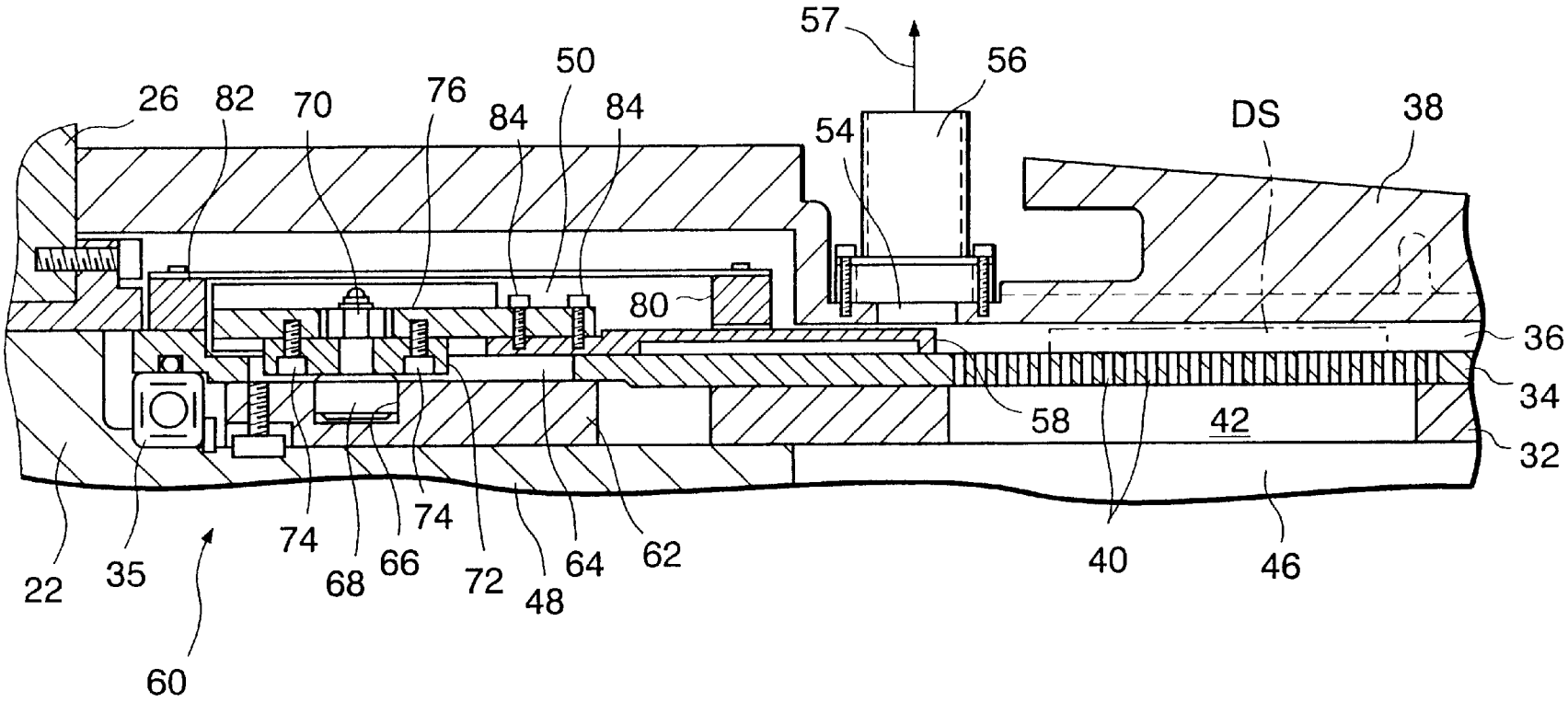
FIG. 7 is a partially enlarged view of FIG. 3.

As can be seen from FIG. 7, a suction opening 54 is formed in the shell cover 38. The suction opening 54 is located at the above-mentioned receiving position with respect to the circumferential direction of the drum shell 34. On the other hand, the suction opening 54 is located at a position corresponding to the inner end of the above-mentioned suction region, i.e., inside edges of the first and second suction slots 42, 44 with respect to the axial direction of the receiving grove 36. The suction opening 54 is connected to a suction tube 57 through a connector 56. As shown in FIG. 3, the suction tube 57 is connected to an air sucking source 59 and a pressure adjusting valve 61 is inserted in the suction tube 57. When the receiving groove 36 reaches the receiving position as the drum shell 34 rotates, the air in the receiving groove 36 is discharged through the suction opening 54.

A pusher rod 58 is arranged in each receiving groove 36 and can be moved within the receiving groove 36 in the axial direction thereof. The pusher rod 58 is located between the inner end of the receiving groove 36 and the suction region thereof.

Each pusher rod 58 can be reciprocated in the corresponding receiving groove 36 through a cam mechanism 60 as the drum shell 34 rotates. The cam mechanism 60 will next be explained.

As shown in FIG. 7, the cam mechanism 60 has a cylindrical cam 62 fixed to the outer peripheral surface of the fixing sleeve 22. More specifically, the cylindrical cam 62 is also used as one end portion of the control sleeve 32, i.e., one end portion thereof on the side of the main frame 26. The cylindrical cam 62 may be a separate member from the control sleeve 32.

A cam groove 66 is formed on an outer peripheral surface of the cylindrical cam 62 and is formed in an entire circumference of the cylindrical cam 62. A position of the cam groove 66 in the axial direction of the cylindrical cam 62 is changed in accordance with the angular displacement of the drum shell 34.

Cam followers 68 are fitted into the cam groove 66. Each of the cam followers 68 is made of a roller. Each of the cam followers 68 is rotatably mounted on a shaft 70 which is projected outside in a radial direction of the cylindrical cam 62. A connecting plate 72 is mounted on the shaft 70 and a pusher holder 76 is connected to the connecting plate 72 through a pair of connecting screws 74. Here, the shaft 70 and the connecting plate 72 are arranged within a corresponding slot 64 of the drum shell 34. These slot 64 are formed in one end portion of the drum shell 34 and arranged at predetermined intervals in the circumferential direction of the drum shell 34.

Figure 8:
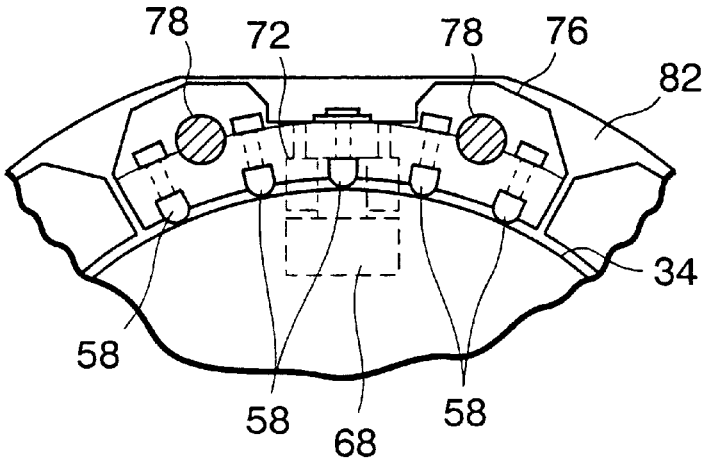
FIG. 8 is a view showing the arrangement of a pusher rod with respect to a pusher holder.

As can be seen from FIG. 8, each pusher holder extends along the circumferential direction of the drum shell 34 and is movably supported by a pair of guide rods 78. The pair of guide rods 78 are separated from each other in the circumferential direction of the drum shell 34 and extend in the axial direction of the drum shell 34.

As shown in FIG. 3, both ends of the guide rods 78 are respectively supported by a pair of rings 80, 82. These rings 80, 82 are arranged on the drum shell 34 and can be rotated integrally with the drum shell 34.

For example, five pusher rods 58 are attached to each pusher holder 76 (see FIG. 8), respectively. More specifically, as shown in FIG. 7, a proximal end of each of the pusher rods 58 is connected to the pusher holder 76 through a pair of connecting screws 84 and a distal end portion of each of the pusher rods 58 passes through the ring 80. Notches are therefore formed in an arc shape on an inner surface of the ring 80 and allow the passing of each of the pusher rods 58.

When each pusher holder 76 is rotated together with the drum shell 34, the cam follower 68 of the pusher holder 76 is moved along the cam groove 66 of the cylindrical cam 62. As a result, while the pusher holder 76 is guided by the pair of guide rods 78, the pusher holder 76 is reciprocated in the axial direction of the cylindrical cam 62. Namely, the five pusher rods 58 attached to the pusher holder 76 are synchronously reciprocated within a corresponding receiving groove 36 in accordance with a profile of the cam groove 66. When the pusher rod 58 is located in a rest position shown in FIG. 7, the distal end of the pusher rod 58 is located in a position retracted from the suction region of the corresponding receiving groove 36.

Figure 9:
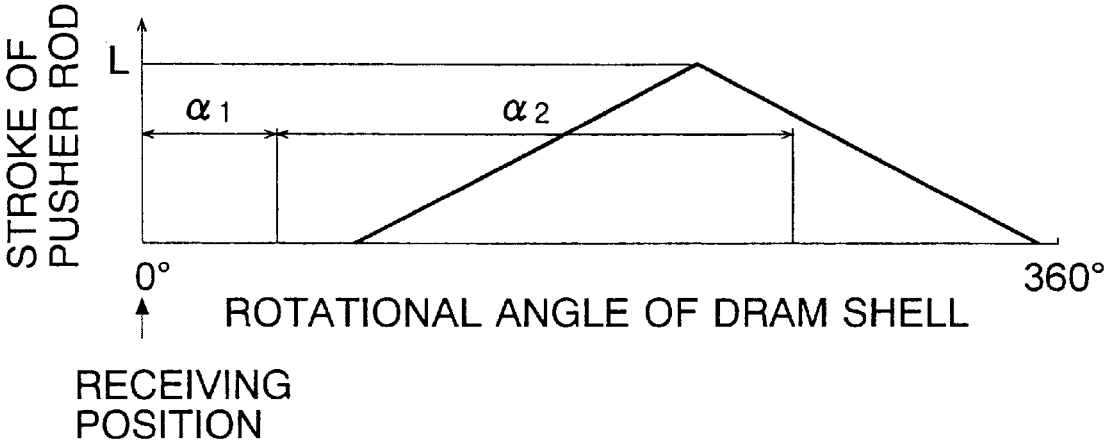
FIG. 9 is a graph showing the relation between a rotating angle of the catcher drum and a stroke of the pusher rod.

A change in stroke of the pusher rod 58 with respect to the angular displacement of the drum shell 34 is shown in FIG. 9. For example, a maximum stroke L of the pusher rod 58 is set to 40 cm. In FIG. 9, a rotational angle 0° of the drum shell 34 shows the above-mentioned receiving position.

An operation of the above-mentioned receiving device will be explained as follows.

Figure 10:
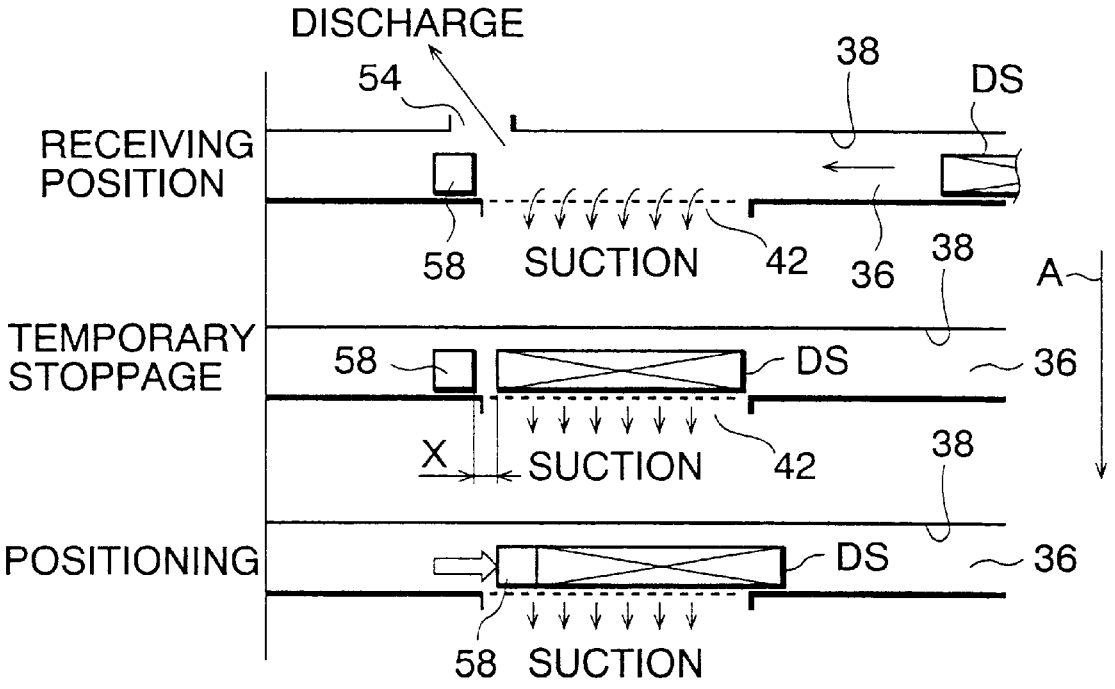
FIG. 10 is a view for explaining positioning of a double cigarette in the receiving groove.

When one receiving groove 36 reaches the receiving position as the drum shell 34 rotates, the receiving groove 36 forms a tunnel passage in cooperation with the shell cover 38 (see FIG. 5). At this time, as shown in FIG. 10, a double cigarette DS is delivered from the conveying path of the cigarette manufacturing machine into the receiving groove 36. Thereafter, the received double cigarette DS advances within the receiving groove 36 toward the pusher rod 58 in the rest position. Here, the double cigarette DS is delivered from the conveying path of the cigarette manufacturing machine by a kicker device (not shown). More specifically, when the double cigarette DS is delivered from the conveying path of the cigarette manufacturing machine, the receiving groove 36 passes through the receiving position at the same time. The receiving grooves 36 can therefore receive the double cigarettes DS one by one while the drum shell 34 rotates.

When the receiving groove 36 passes through the receiving position, the receiving groove 36 is connected to the suction opening 54 and the suction holes 40 of the receiving groove 36 are communicated with the first suction slot 42 of the control sleeve 32. Therefore, as shown in FIG. 10, the air in the receiving groove 36 is discharged from the suction opening 54 and the suction holes 40. As a result, the double cigarette DS entered into the receiving groove 36 is pulled toward the pusher rod 58.

Here, an approaching speed of the double cigarette DS from the conveying path is low at a start-up time of the operation of the cigarette manufacturing machine and in a low speed operating thereof. However, as mentioned above, the air in the receiving groove 36 is discharged from both the suction holes 40 and the suction opening 54. Accordingly, this discharged air assists the advance of the double cigarette DS so that the double cigarette DS can be reliably moved toward the pusher rod 58.

Thereafter, when the double cigarette DS in the receiving groove 36 enters a region of the suction holes 40, the discharged air from the suction holes 40, i.e., suction is applied as braking force to the double cigarette DS. As a result, as shown in FIG. 10, the double cigarette DS receives the braking force by the suction so that the double cigarette DS is temporarily stopped in the suction region in the receiving groove 36. The temporary stopping of the double cigarette DS is kept while the receiving groove 36 is moved within the first angular region $\alpha 1$ of the drum shell 34. Here, the clearance X between the double cigarette DS in a temporary stopping position and the pusher rod 58 is preferably limited to ¼ (e.g., 10 cm) of a maximum stroke L or less of the pusher rod 58. The temporary stopping position of the double cigarette DS is set between the pusher rod 58 in the rest position and a normal position of the double cigarette described later. Accordingly, the double cigarette DS overruns the normal position and then is temporarily stopped.

Thereafter, when the drum shell 34 further rotates, the receiving groove 36, together with the double cigarette DS, enters from the first angular region $\alpha 1$ to the second angular region $\alpha 2$ and moves within this second angular angle region $\alpha 2$. At this time, the sucking holes 40 of the receiving groove 36 are communicated with the second suction slot 44 instead of the first suction slot 42. Here, the negative pressure supplied to the second suction slot 44 is weaker than that supplied to the first suction slot 42 so that suction force of the double cigarette DS in the receiving groove 36 is reduced. However, in this case, the double cigarette DS can be sufficiently held in the receiving groove 36 by the suction force applied to the double cigarette DS. Accordingly, no double cigarette DS drops from the receiving groove 36.

When the drum shell 34 is further rotates and the receiving groove 36, together with the double cigarette DS, reaches a predetermined rotational angle within the second angular region $\alpha 2$, the pusher rod 58 in the receiving groove 36 is started to move from the rest position thereof at this time toward the double cigarette DS. Thereafter, as shown in FIG. 10, when the distal end of the pusher rod 58 comes in contact with the double cigarette DS in the temporary stopping state, the pusher rod 58 pushes back the double cigarette DS against holding force provided through the suction holes 40 until the pusher rod 58 reaches the maximum stroke L thereof. Thus, the double cigarette DS is moved until the normal position and is accurately positioned in this normal position.

Here, as mentioned above, the five pusher rods 58 are attached to the pusher holder 76 so that every five double cigarettes DS are positioned on the drum shell 34 at the same time.

As mentioned above, the clearance X between the pusher rod 58 in the rest position and the double cigarette DS in the temporary stopping position is limited to about ¼ of the maximum stroke L of the pusher rod 58. Therefore, when the distal end of the pusher rod 58 pushes back the double cigarette DS, a pushing-out speed of the pusher rod 58 does not still reach its maximum speed. Accordingly, the distal end of the pusher rod 58 comes in soft contact with the double cigarette DS so that this contact does not damage the cut end of the double cigarette DS. When the distal end of the pusher rod 58 strongly runs into the cut end of the double cigarette DS, there is a case in which wrapping paper is wrinkled in the end portion of the double cigarette DS and shredded tobacco drops from the cut end of the double cigarette DS. However, such disadvantages can be cured by making the pusher rod 58 softly push against the double cigarette DS.

When the double cigarette DS is pushed back until the normal position, the double cigarette DS is merely held by a relatively weak negative pressure, i.e., holding force. Therefore, the double cigarette DS is smoothly pushed back by the pusher rod 58.

As mentioned above, the double cigarette DS is finally positioned mechanically by the pusher rod 58. Accordingly, when a slight dispersion in the temporary stopping position of the double cigarette DS is caused, the double cigarette DS is accurately positioned in the normal position irrespective of this dispersion.

Thereafter, when the drum shell 34 is further rotates and the receiving groove 36 enters the third angular region $\alpha 3$ together with the double cigarette DS, the suction holes 40 of the receiving groove 36 are communicated with the atmospheric groove 43. As a result, the suction force of the double cigarette DS is released at this time. The double cigarette DS in the receiving groove 36 is transferred to the next grooved drum adjacent to the catcher drum 4 in the drum train 2 simultaneously when the suction force of the double cigarette DS is released. The double cigarette DS is then conveyed toward the rolling section 6 on the drum train 2.

After the double cigarette DS is positioned in the normal position, the pusher rod 58 is returned toward the rest position in the receiving groove 36. As can be seen from FIG. 9, the pusher rod 58 is returned to the rest position just before the receiving groove 36 reaches the receiving position next time.

When the receiving groove 36 is moved from the atmospheric groove 43 toward the receiving position as the drum shell 34 rotates, the suction holes 40 of the receiving groove 36 are connected to the blow slot 47 and receives compressed air supplied from this blow slot 47. Accordingly, the compressed air is ejected from the suction holes 40 of the receiving groove 36 and cleans the interior of the receiving groove 36. Thus, the advance of the double cigarette DS in the receiving groove 36 and the pushing-back of the double cigarette DS using the pusher rod 58 are not prevented by wastes of shredded tobacco, dust, etc. in the receiving groove 36.

No application of the receiving device according to the present invention is limited to the catcher drum of the above-mentioned filter attachment, but this receiving device can be applied to a catcher drum for receiving various kinds of rod members.

What is claimed is:

1. A receiving device for receiving a rod member conveyed on a conveying path in an axial direction of the rod member, said receiving device comprising:

a receiving drum rotatably arranged on a terminal end side of the conveying path, said receiving drum including an outer peripheral surface moved in a direction crossing the conveying path and receiving grooves formed on the outer peripheral surface of said receiving drum at equal intervals in a circumferential direction thereof, each of the receiving grooves sequentially passing through a receiving position opposed to the terminal end of the conveying path as said receiving drum rotates, so that each of the receiving grooves receives the rod member delivered from the conveying path through an inlet of the receiving groove and allowing the received rod member to advance in an axial direction of the receiving drum;

braking means for applying braking force to the rod member in the receiving groove and stopping the advance of the rod member therein; and positioning means for pushing back the rod member stopped in the receiving groove toward the inlet of the receiving groove and positioning the rod member in a normal position defined in the receiving groove, said positioning means including a pusher movably arranged in each receiving groove, the pusher having a rest position separated by a predetermined distance from the rod member stopped by said braking means.

2. The device according to claim 1, wherein said braking means includes a cover for covering the outer peripheral surface of said receiving drum and extending from the receiving position in the circumferential direction of said receiving drum with respect to a rotating direction of said receiving drum so that the receiving groove in the cover is formed in a tunnel shape;

suction holes formed on a bottom surface of each of the receiving groove; and first suction means for applying first suction to the suction holes in a predetermined angular region of said receiving drum after the receiving groove moves into the cover, the first suction producing the braking force.

3. The device according to claim 2, wherein said braking means further includes discharging means for discharging air in the receiving groove and pulling the rod member in the receiving groove toward a temporary stopping position, the discharging means having a discharging port formed in the cover.

4. The device according to claim 3, wherein the discharging port is arranged at the receiving position with respect to a circumferential direction of the cover.

5. The device according to claim 3, wherein the discharging means further includes adjusting means for adjusting discharging force for the receiving groove.

6. The device according to claim 2, wherein said positioning means further includes reciprocating means for reciprocating the pusher in the receiving groove at a predetermined stroke.

7. The device according to claim 6, wherein the reciprocating means has cam means utilizing rotation of said receiving drum for the reciprocation of the pusher.

8. The device according to claim 7, wherein the cam means allows the pusher to come in contact with the rod member before a moving speed of the pusher becomes a maximum speed thereof when the pusher is moved from the rest position toward the rod member.

9. The device according to claim 6, wherein said positioning means further includes second suction means for applying second suction to the sucking holes of the receiving groove and holding the rod member in the receiving groove, the second suction is weaker than the braking force.

10. The device according to claim 1, wherein said device further comprises cleaning means for cleaning an interior of the receiving groove by compressed air before each of the receiving grooves reaches the receiving position.

* * * * *